US005286016A

United States Patent [19]

Franks

[11] Patent Number: 5,286,016

[45] Date of Patent: Feb. 15, 1994

[54] APPARATUS AND METHOD FOR INSERTING SHEETS INTO LAPSTREAM IN A DIRECTION OPPOSITE TO CONVEYING DIRECTION

[75] Inventor: James M. Franks, Burlingame, Kans.

[73] Assignee: Brackett, Inc., Topeka, Kans.

[21] Appl. No.: 945,745

[22] Filed: Sep. 16, 1992

[51] Int. Cl.[5] ..... B65H 39/02

[52] U.S. Cl. ..... 270/57; 270/58

[58] Field of Search ..... 270/54, 55, 57, 58, 270/59, 95; 414/789.5; 198/418.8

[56] References Cited

U.S. PATENT DOCUMENTS

| | | | |
|---|---|---|---|
| 2,619,883 | 12/1952 | Andren | 270/95 |
| 2,666,372 | 1/1954 | Lauffer . | |
| 2,676,523 | 4/1954 | Strecker . | |
| 2,837,016 | 6/1958 | Jezierski . | |
| 2,855,833 | 10/1958 | Rugg et al. . | |
| 3,122,391 | 2/1964 | Didde et al. . | |
| 3,205,739 | 9/1965 | Meyer-Jagenberg . | |
| 3,458,186 | 7/1969 | Schmidt . | |
| 3,466,983 | 9/1969 | Meyer-Jagenberg | 270/95 |
| 3,545,741 | 12/1970 | Porth | 270/58 |
| 3,555,978 | 1/1971 | McCool . | |
| 3,948,153 | 4/1976 | Dutro et al. . | |
| 3,971,916 | 7/1976 | Moreno . | |
| 3,979,112 | 9/1976 | Munn et al. | 270/58 |
| 4,172,531 | 10/1979 | Muller . | |
| 4,307,830 | 12/1981 | Didde . | |
| 4,478,399 | 10/1984 | Morin et al. | 270/57 X |
| 4,602,775 | 7/1986 | Calhoun et al. . | |
| 4,749,179 | 6/1988 | Hornung . | |
| 4,824,092 | 4/1989 | Kriefall et al. | 271/183 |
| 4,867,432 | 9/1989 | Matta | 270/54 X |
| 4,944,503 | 7/1990 | Arima . | |
| 5,000,434 | 3/1991 | VanderSvde | 270/54 |

FOREIGN PATENT DOCUMENTS

| | | | |
|---|---|---|---|
| 403811 | 12/1965 | Sweden | 270/57 |

*Primary Examiner*—Edward K. Look
*Assistant Examiner*—John Ryznic
*Attorney, Agent, or Firm*—Litman, McMahon & Brown

[57] ABSTRACT

An apparatus for inserting chipboard or cardboard spacers within a lapstream of paper sheets exiting a press on a lapstream conveyor includes a chipboard ejector for firing chipboards toward the lapstream conveyor in a direction which is opposite that of the conveyor. A plurality of vacuum feet are positioned over the conveyor and are responsive to a control pulse issued by a programmable counter to pick up the leading edge of selected sheets in the lapstream. Simultaneously, the chipboard ejector fires a chipboard, in response to another control pulse from the counter, toward the point on the conveyor over which the sheet is being picked up. The vacuum feet are then released, dropping the selected paper sheet and the chipboards are thus reliably inserted at regular intervals within the lapstream. Multiple chipboards can be inserted in a single location by varying the length of the chipboard ejector control pulse.

23 Claims, 4 Drawing Sheets

APPARATUS AND METHOD FOR INSERTING SHEETS INTO LAPSTREAM IN A DIRECTION OPPOSITE TO CONVEYING DIRECTION

BACKGROUND OF THE INVENTION

The invention relates to an apparatus for inserting chipboard or cardboard spacers at regular intervals between paper sheets being fed by a press onto a lapstream conveyor for making writing tablets or the like.

The insertion of chipboard or cardboard spacers in a stream of paper sheets on a lapstream conveyor issuing from a press without slowing or stopping the press and/or conveyor has long presented a problem within the industry. The term "lapstream" refers to the manner in which the sheets are arranged on the conveyor in an overlapped stream.

Many prior inserting devices have placed chipboard spacers after the paper sheets have been deposited in a vertical stack at the end of the conveyor. This has necessitated the insertion of a mechanical finger at appropriate points in the paper stack to lift the topmost sheets while a chipboard ejector injects a chipboard spacer under the mechanical finger. Such an operation can result in damage to the paper sheets by the mechanical finger or the chipboard injector and precise positioning of the mechanical finger in the stack is difficult. This can result in differing numbers of sheets in the tablets.

A different approach for relatively small production facilities has been to divert a plurality of sheets from the continuous lapstream to mark a point at which a chipboard spacer is to be inserted. This is a time consuming process which requires an operator to physically pick up the paper bundles between diversions and put the spacers in place. It is not suitable for large, high speed presses.

Yet another approach has been to insert chipboard spacers into a vertical stack as the paper sheets are being fed to the stack. Generally, the flow of sheets to the stack has been temporarily interrupted while the spacers are inserted, thus resulting in lost production time and inefficiency.

Prior art attempts to interleave chipboard spacers or covers within paper sheets on a lapstream conveyor belt before they are vertically stacked have generally included parallel feeders where the paper sheets and the spacers are on parallel tracks and are fed into the lapstream from the same direction. In such parallel operations, complex and precisely timed counters, rollers and injectors have been required, resulting in machines which are difficult to synchronize and maintain. Any imprecision in timing between the parallel feeders can result in machine jams and consequent down time and productivity loss. Furthermore, it has been impossible to add a parallel chipboard spacer inserter to an existing conveyor, i.e. such inserters must necessarily be integrated into the lapstream conveyor when it is manufactured.

It is clear then, that a relatively simple and inexpensive chipboard inserter which efficiently and reliably inserts chipboard spacers at precise points within a paper sheet lapstream is needed. It is also clear that such an inserter should be capable of being added to an existing lapstream conveyor and that it should work without requiring the press and/or the lapstream conveyor to be slowed or stopped. Such an inserter should be capable of automatic operation so that a single operator can supervise a plurality of inserters in a modern, high-speed printing shop.

SUMMARY OF THE INVENTION

The present invention is a chipboard inserter for reliably and efficiently inserting chipboard or cardboard spacers at precise intervals within an overlapped stream of paper sheets on a lapstream conveyor. The inserter operates in an "opposed" fashion, i.e. the chipboard spacers are fed into the paper sheet lapstream in a direction which is opposite to the direction of the conveyor and the paper sheets themselves. The inserter includes a programmable sheet counter for counting the number of paper sheets in the lapstream and a batch counter for counting the number of spacers inserted into the paper stream. The programmable sheet counter has two control outputs which each generate a control output pulse in response to the sheet counter reaching a preset sheet count. A first control output pulse signals a vacuum valve solenoid to apply a vacuum to a plurality of vacuum "feet" positioned above the paper lapstream. The vacuum feet then lift one of the paper sheets in the lapstream for a split second. The second control output pulse signals a clutch solenoid to operate a clutch to spin a feeder belt to push a chipboard spacer in between two pinch rollers which, in turn, fire or eject the spacer toward the point on the lapstream conveyor above which the vacuum feet are positioned. The chipboard spacer lands under the lifted sheet whereupon the vacuum is released and the lifted sheet drops back into place on top of the chipboard spacer.

The entire process is repeated each time the sheet counter reaches the preset count limit which represents the number of paper sheets to be separated by the chipboard spacers, e.g. into tablets. Both the pinch rollers and the feeder belt are driven by a continuously running variable speed motor which is housed within a motor housing. A vacuum pump charges a vacuum chamber which is tapped into by the vacuum valve solenoid to provide a vacuum source for the vacuum feet. The vacuum pump is also housed within the motor housing. Both the speed of the motor and the position of the vacuum feet on the lapstream conveyor are adjustable to accommodate different lengths of paper sheets within the lapstream, as well as conveyors operating at different speeds. The length of the second output pulse is adjustable as well so that, in applications where multiple chipboards must be inserted within a paper lapstream, such as where front and back chipboards are attached to a tablet, it can be lengthened to cause the clutch to spin the feeder belts to eject two or more chipboards. The entire chipboard inserter apparatus is portable and can be easily and quickly added to any suitable lapstream conveyor to add chipboard spacer insertion capability to existing presses.

OBJECTS AND ADVANTAGES OF THE INVENTION

The principal objects of the present invention are: to provide an improved chipboard inserter apparatus for reliably and efficiently inserting chipboard spacers at preselected intervals within an overlapped paper sheet stream on a lapstream conveyor; to provide such an apparatus which includes a programmable sheet counter for counting paper sheets within the stream and providing two control output pulses upon reaching a preset count; to provide such an apparatus which includes a plurality of vacuum feet for momentarily lifting selected paper sheets within the lapstream; to provide such an apparatus with a chipboard spacer ejector which selectively fires or ejects a chipboard spacer via a set of pinch rollers toward the point in the lapstream at which a paper sheet is being raised by the vacuum feet; to provide such an apparatus in which a vacuum valve solenoid selectively controls a vacuum valve to supply a vacuum to the vacuum feet from a vacuum chamber; to provide such an apparatus in which a clutch solenoid selectively controls a clutch to drive a spacer feed belt which feeds one or more spacers to the pinch rollers of the ejector; to provide such an apparatus in which the vacuum solenoid and the clutch solenoid are controlled by the respective control output pulses of the sheet counter; to provide such an apparatus which includes a continuously operating variable speed motor for driving the set of pinch rollers in the chipboard ejector and the spacer feed belt; to provide such an apparatus with separate manual controls for the vacuum solenoid and the clutch solenoid; to provide such an apparatus which can be added to an existing lapstream conveyor system; to provide such an apparatus which is relatively small, easily transportable and economically manufacturable; and, to provide such an apparatus which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limited, but merely as a basis for the claims and as a representative basis for teaching one skilled in the art to variously employ the present invention in virtually any appropriately detailed structure.

Figure 1:
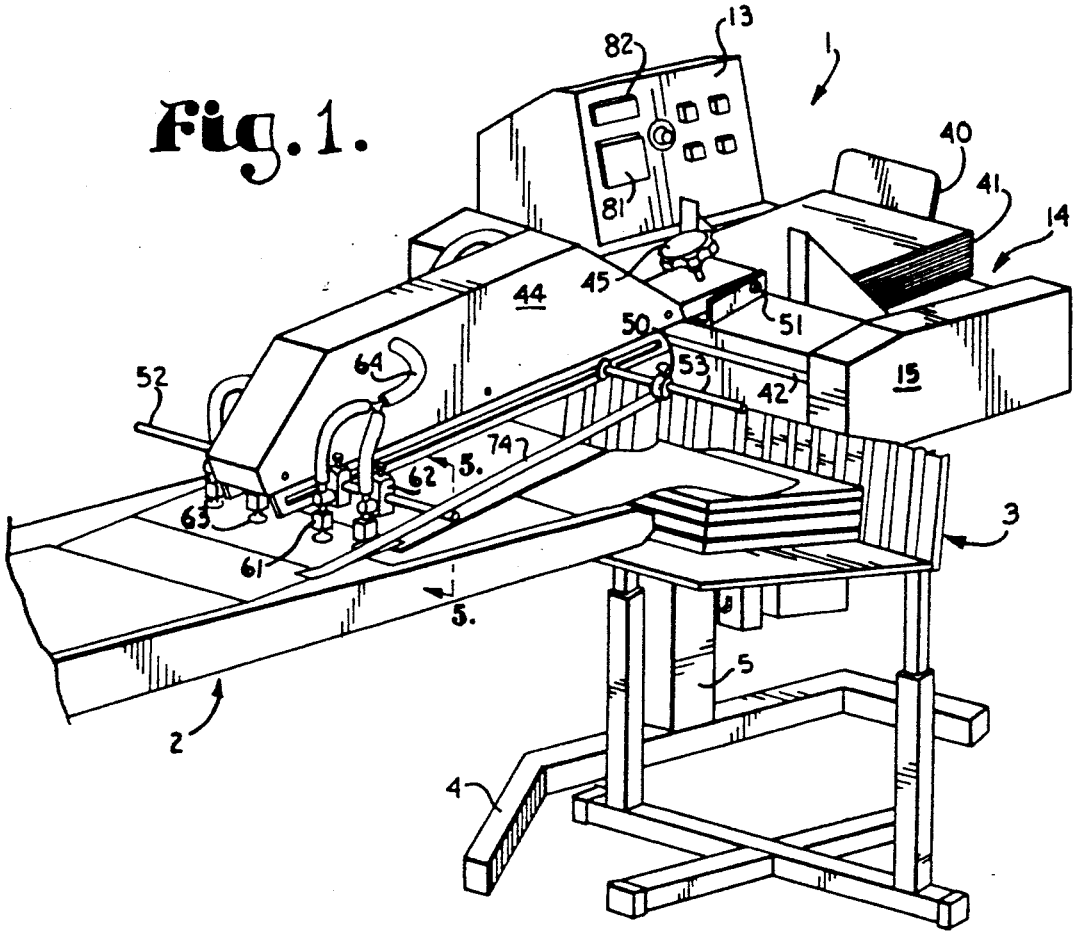
FIG. 1 is a perspective view of a chipboard inserter apparatus in accordance with the present invention, shown attached to a lapstream conveyor.
Figure 3:
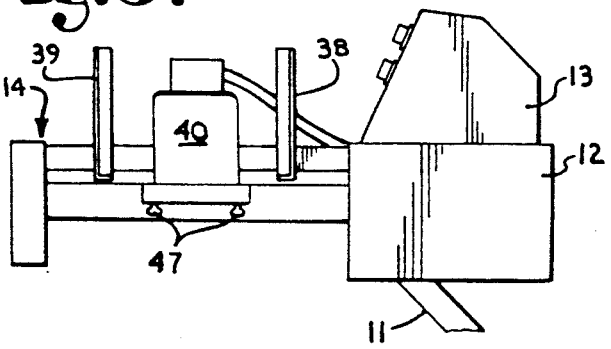
FIG. 3 is a fragmentary end elevational view of the chipboard inserter apparatus.

Referring to the drawings in more detail, reference numeral 1 generally designates a chipboard inserter apparatus in accordance with the present invention. The inserter apparatus 1 in FIG. 1 is shown in cooperative engagement with a representative lapstream conveyor 2 and a height adjustable paper stack support stand 3, which may be a vibrating sheet jogger. The inserter apparatus 1 includes a U-shaped horizontal base 4, which can be equipped with optional wheels (not shown) for ease in transport, and a vertical support member 5. The vertical support member 5 has an angled section 11 at the top thereof (FIG. 3) which is attached to a motor, clutch and vacuum pump housing 12. A control panel 13 sits on top of the motor housing 12, and a chipboard ejector assembly 14 is attached to the motor housing 12 in a cantilevered arrangement, as best illustrated in FIG. 3. By supporting the ejector 14 in such a fashion, the chipboard inserter 1 can be easily maneuvered into position near lapstream conveyors and paper trays of a variety of configurations and sizes without concern for support members directly beneath the ejector 14.

Figure 7:
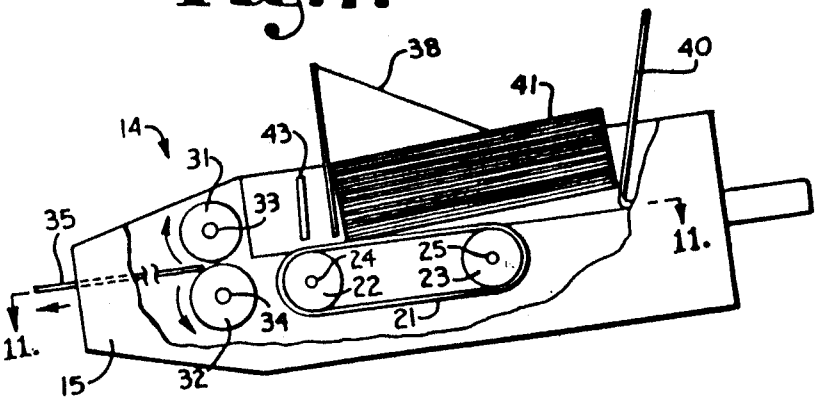
FIG. 7 is an enlarged, fragmentary side elevational view of the chipboard spacer ejector with portions of a wall broken away to show a stack of spacers, the spacer feed roller and the pinch rollers.
Figure 10:
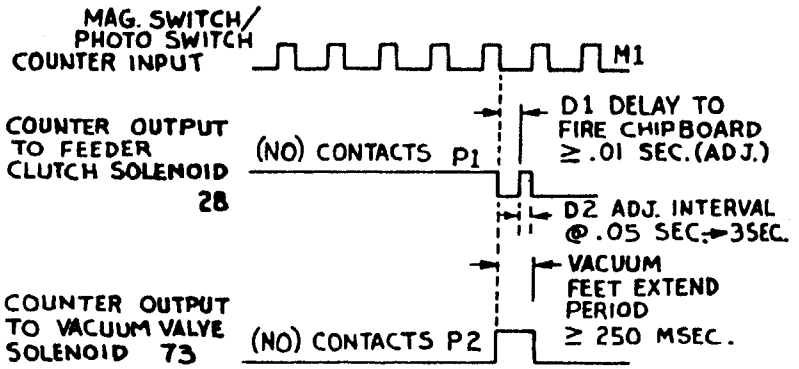
FIG. 10 is a timing graph illustrating timing relationships for the sheet counter circuit.
Figure 11:
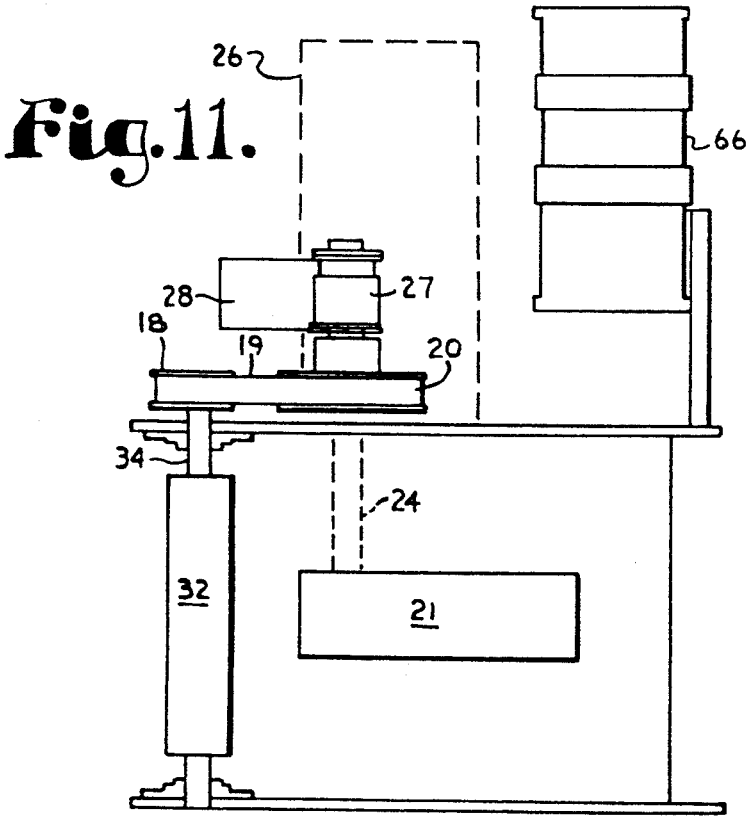
FIG. 11 is a top plan section taken on line 11—11 of FIG. 7 and shows the motor, pinch roller drive, clutch and vacuum pump for the chipboard inserter apparatus with the motor housing removed.

The chipboard ejector 14 will now be described with reference to FIG. 7. FIG. 7 shows the ejector 14 with a side cover 15 partially cut away to illustrate the interior thereof. A chipboard feed belt 21 is driven by a pair of rollers 22 and 23 which are attached to shafts 24 and 25, respectively. The shaft 24 is a drive which is connected via a wrap spring clutch 27 (FIGS. 9 and 11), a pulley 20, and a belt 19 to a continuously running, variable speed motor 26 in the housing 12. A pair of pinch rollers 31 and 32 are also connected to the motor by a pair of drive shafts 33 and 34, respectively, but the pinch rollers 31 and 32 are constantly turning in the directions indicated in FIG. 7 whenever the motor 26 is running. The lower pinch roller shaft 34 has a pulley 18 thereon having the belt 19 engaged therewith which engages a drive pulley (not shown) of the motor 26. In FIG. 11, the motor 26 is mounted above the section plane of FIG. 11 and is, therefore, shown in phantom. A clutch solenoid 28 is also enclosed within the housing 12 and, when enabled by a control pulse P1 (FIG. 10), operates the clutch 27 to drive the rollers 22 and 23 through a 180 degree rotation, which is sufficient to force the bottommost chipboard 35 from the chipboard stack 41 in between the pinch rollers 31 and 32, which pinch rollers 31 and 32, with their opposing rotation directions, eject the chipboard 35 through a window 42 (FIG. 1) in the ejector 14. The control pulse P1 is adjustable from 0.05 to 3 seconds to selectively control the clutch solenoid 28 to cause the clutch 27 to rapidly and sequentially eject multiple chipboards 35 for applications where multiple chipboards are inserted within a paper stream.

A height-adjustable knife 43 which is adjusted via a screw 46 (FIG. 2), insures that only one chipboard at a time can enter the pinch rollers 31 and 32. A chipboard end support 40 is slidably adjustable for various lengths of chipboards 35 via a pair of thumb screws 47 (FIG. 3) operating in a like pair of slots (not shown) within the ejector 14. Similarly, a pair of chipboard side supports 38 and 39 are adjustable for chipboards of varying widths by sliding them along a rod 37 and tightening them via a respective pair of tensioning screws 48 and 49.

Figure 4:
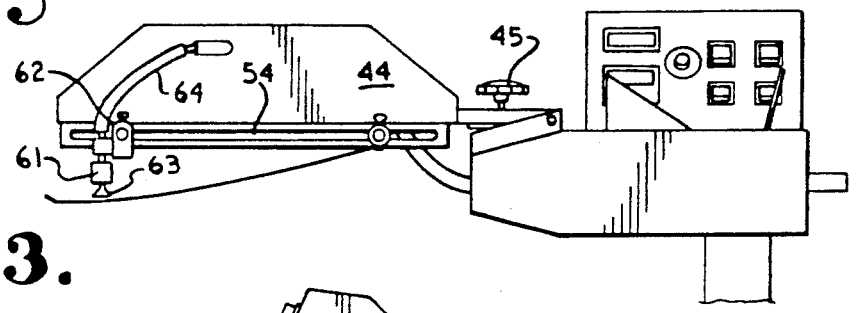
FIG. 4 is a fragmentary side elevational view of the chipboard inserter apparatus, showing the vacuum chamber housing, adjustable support rods and vacuum feet.

Pivotally attached to the front of the chipboard ejector 14 is a vacuum chamber housing 44 (FIGS. 1 and 4). The chamber 44 is angularly adjustable via an adjustment knob 45, which, when it is turned clockwise, urges the housing upward about a pivot connection 51. A pair of transverse support rods 52 and 53 extend through a pair of slots 54, one on either side of the chamber housing 44. The support bars 52 and 53 are adjustable longitudinally along the chamber housing 44 via the slots 54. The support bar 52 has a plurality of vacuum "feet" 61 attached to it via a like plurality of adjustable connectors 62. Suitable vacuum feet are available "off-the-shelf" under the title "Big Feet" by Mich-Ren Products and are described in U.S. Pat. No. 4,580,773, which is incorporated herein by reference. When a vacuum is supplied to the vacuum feet 61 from a vacuum chamber 65 (FIG. 9) within the chamber housing 44 via vacuum lines 64, suction cups 63 are extended to contact a paper sheet 71, as shown in phantom lines in FIG. 5. The suction cups 63 are then retracted, drawing the paper sheet 71 upward with vacuum pressure supplied to the cups 63 via a connecting tube 72. A Vacuum valve solenoid 73 (FIG. 9) is contained within the chamber housing 44. The vacuum valve solenoid 73, when enabled by a control pulse P2 (FIG. 10), taps the vacuum chamber 65 to provide a vacuum source for the vacuum feet 61. When the vacuum valve solenoid 73 is released at by the end of the control pulse P2, the vacuum source for the vacuum feet 61 is removed and the paper sheet 71 is released. The vacuum lines 64 preferably have manually adjustable valves (not shown) to control the vacuum applied by the vacuum feet 61 to the sheet 71 and in line filters (not shown) to prevent or reduce the ingestion of paper dust into the vacuum system.

Figure 2:
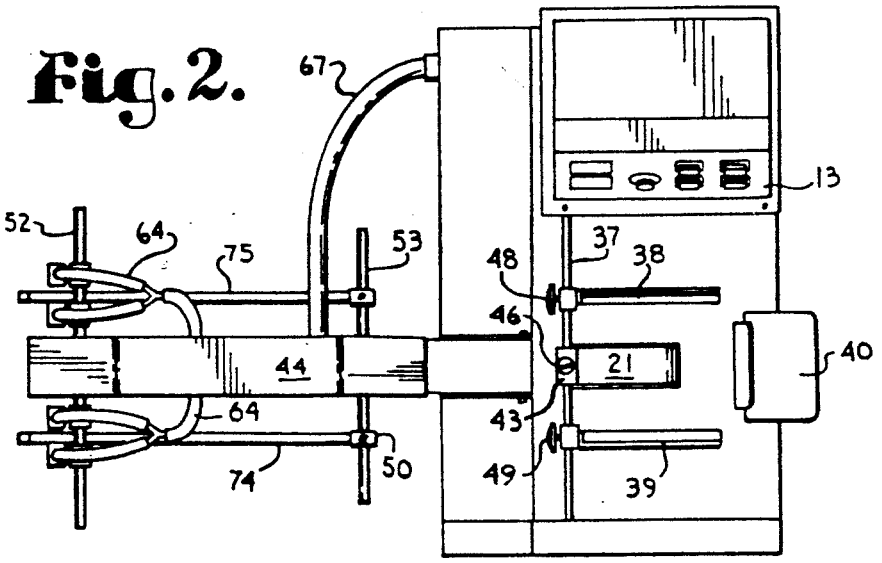
FIG. 2 is a top plan view of the chipboard inserter apparatus.

A pair of elongate leaf springs 74 and 75 (FIG. 2) are adjustably attached to the support bar 53 and extend over the support bar 52 to contact the paper sheet 71 on the conveyor 2. The leaf springs 74 and 75 serve to urge the trailing edge of the paper sheet 71 downward as the vacuum feet 61 pick up the leading edge of the sheet 71 so that the paper sheet stream remains in an overlapped condition. A vacuum pump 66 (FIG. 11) supplies a vacuum to the vacuum chamber 65 via a supply line 67 (FIG. 2).

Figure 6:
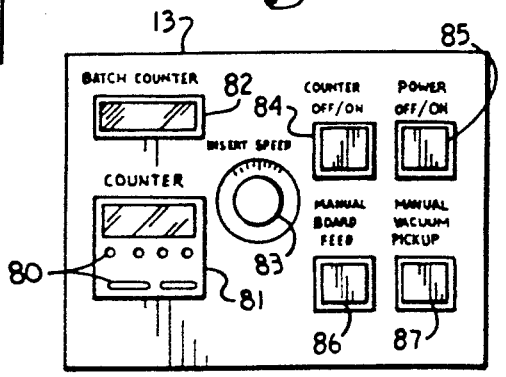
FIG. 6 is an enlarged frontal view of the control panel for the chipboard inserter apparatus.
Figure 8:
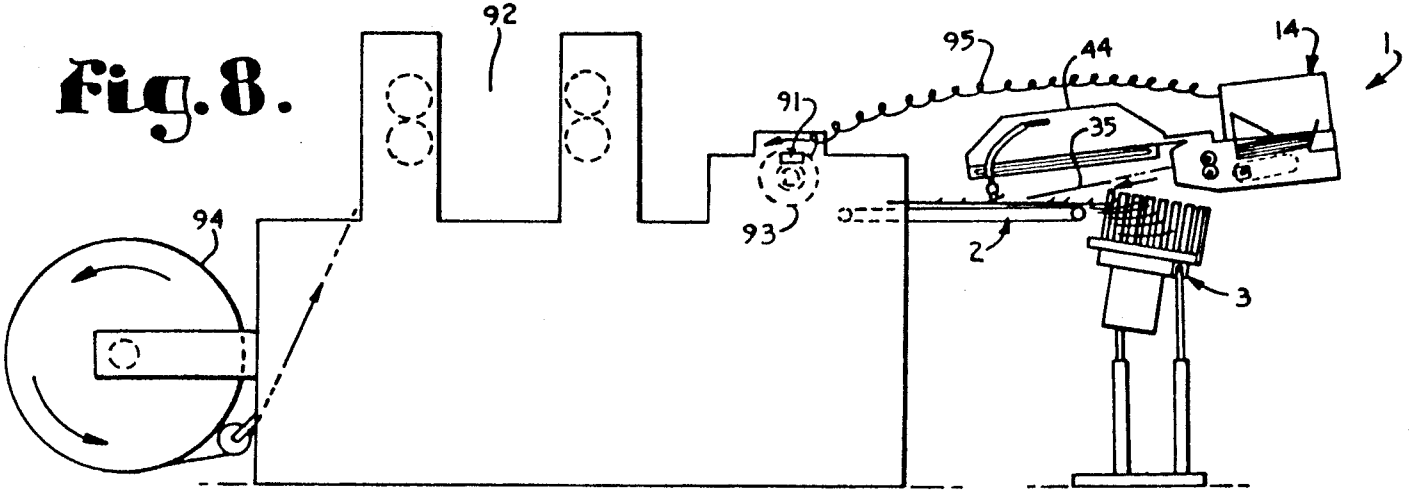
FIG. 8 is a side elevational view at a reduced scale and illustrating the chipboard inserter apparatus attached to a lapstream conveyor of a continuous web press, with the sheet counter input magnetically coupled to a paper knife cylinder on the press.
Figure 9:
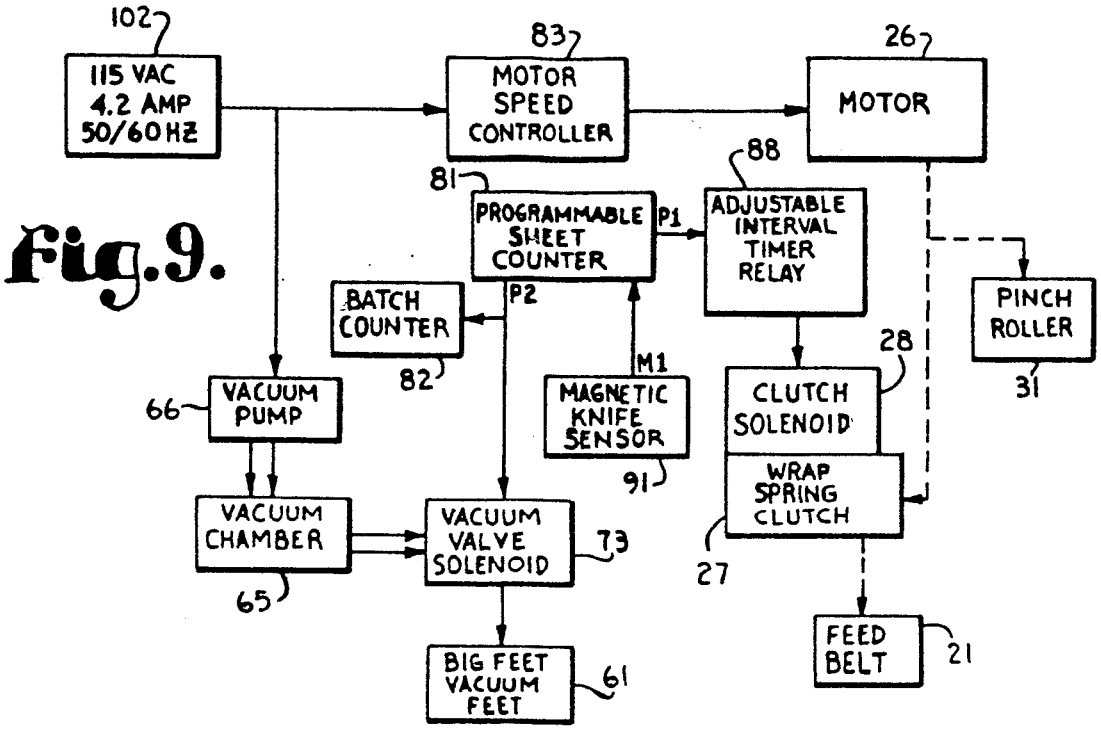
FIG. 9 is a block diagram illustrating electrical and mechanical control components for the chipboard inserter apparatus.

With reference to FIG. 6, the control panel 13 comprises a programmable sheet counter 81, which counts the number of sheets output by the press 92 (FIG. 8). The sheet counter 81 has a number of set buttons 80 which are used to select the first or second output pulse, labeled P1 and P2 (FIG. 10), respectively, and to set the preset count limit at which the pulses P1 and P2 are generated. The lengths of the pulses P1 and P2 are selectable as well, from 0.01 to 999.9 seconds. FIG. 10 illustrates a typical timing diagram for the sheet counter 81. In this instance, for purposes of illustration only, the sheet counter 81 has been preset to output both the pulse P1 and the pulse P2 at the count of 5. The output pulse P1 is divided into an adjustable delay D1 of at least 0.01 seconds and an adjustable interval D2 of 0.05 to 3 seconds, provided by an adjustable interval timer relay 88 (FIG. 9). The pulse P2 allows the vacuum feet 61 to extend and return with the edge of the sheet 71 in a held up position. The adjustable interval timer 88 is initiated after the position of vacuum feet 61 has stabilized, activating the clutch solenoid 28. The output pulse P2 is preset for a pulse width of at least 250 milliseconds and is supplied as a control input to the vacuum valve solenoid 73. The "Libra Series" counter marketed by Red Lion Controls was used for the sheet counter 81 in one embodiment of the present invention.

FIG. 8 illustrates a suitable generator for the input signal for the sheet counter 81 in the form of a magnetic knife sensor 91 which is attached to a rotary paper knife cylinder 93 on a representative continuous Web press, generally designated as 92. The magnetic sensor 91 sends an output pulse M1 (FIG. 10) each time the knife cylinder 93 cuts a paper sheet from the continuous paper web 94. The sheet counter 81 thus counts the number of pulses M1 output by the magnetic knife sensor 91. It should be noted that any suitable paper sheet sensor, including a photoelectric sensor positioned on the end of the knife cylinder 93 to sense the ends of blades rotating therewith, could be used to supply sheet count pulses M1 to the counter 81.

The control panel 13 also includes a batch counter 82 which counts the number of control pulses P2 output by the counter 81, and, thus the number of "batches" of paper sheets separated by chipboard spacers 35. In addition, the panel 13 includes a motor speed controller 83, a counter off/on switch 84, a power off/on switch 85, a manual chipboard feed switch 86 and a manual vacuum pickup switch 87. The speed controller 83 controls the speed of the motor 26, which controls the speed of the pinch rollers 31 and 32, and thus the speed of ejection of the chipboards 35 from the ejector 14. The counter off/on switch 84 is a power switch and a reset mechanism for the counters 81 and 82. The power off/on switch 85 controls power to the motor 26. The manual board feed switch 86 causes the clutch solenoid 27 to engage the clutch 28 to rotate the feed belt rollers 22 and 23 approximately 180 degrees which causes a single chipboard 35 to be fed to the pinch rollers 31 and 32 and thus be ejected out the window 42. The manual vacuum pickup switch 87 causes the vacuum valve solenoid 73 to apply a vacuum to the vacuum feet 61.

With reference to FIG. 9, a block circuit diagram illustrates the primary electrical and mechanical components of the apparatus 1. A conventional 115 Volt AC power supply 102 delivers power to the motor 26 via the motor speed controller 83. Power is also supplied to the programmable sheet counter 81, the batch counter 82, and the vacuum pump 66. The motor 26 directly drives the pinch rollers 31 and 32 and indirectly drives the chipboard feed belt 21 via the wrap spring clutch 27. The magnetic knife sensor 91 supplies the sheet pulses Ml to the sheet counter 81, which counts them until reaching the preset limit (FIG. 10). The sheet counter 81 then outputs the adjustable control pulses P1 and P2 to the clutch solenoid 28 via an adjustable interval timer 88 and the vacuum valve solenoid 73, respectively, as described above.

The batch counter 82 is connected to the P1 output of the sheet counter 81 to count the number of times that the sheet counter 81 reaches the preset limit, and thus the number of paper batches separated by chipboard spacers. The vacuum pump 66 draws a vacuum on the vacuum chamber 65.

The operation of the chipboard inserter apparatus 1 will now be described. The apparatus 1 is first placed in close proximity to the end of a lapstream conveyor such as the conveyor 2 in FIG. 1. The angle of the vacuum chamber housing 44 relative to the chipboard ejector 14 is adjusted by turning the adjustment knob 45. The longitudinal placement of the support rods 52 and 53 are then adjusted relative to the chamber housing 44 and the lateral placement of the vacuum feet 61 are adjusted along the support rod 52 for proper alignment with the paper sheet lapstream. An input line 95 from a sheet sensor such as the magnetic sensor 91 associated with the press 92 in FIG. 8 is then attached to the sheet counter 81 and the counter input buttons 80 are used to set the counter 81 with the requisite number of sheets per bundle. The press 92, the conveyor 2 and the chipboard inserter apparatus 1 are then all turned on and checked for proper operation and alignment.

Figure 5:
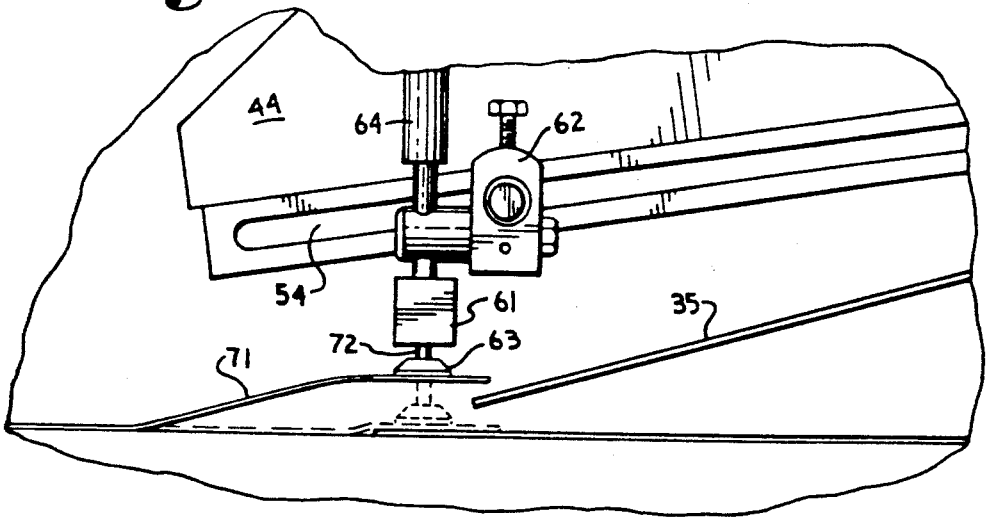
FIG. 5 is an enlarged, fragmentary side elevational view of the chipboard inserter apparatus, taken along line 5—5 of FIG. 1 and showing, in phantom lines the vacuum feet contacting a paper sheet in the lapstream, and in solid lines, the paper sheet being picked up by the vacuum feet.

Once the press 92, the conveyor 2 and the chipboard inserter apparatus 1 are working properly, the counter 81 counts the sheets cut by the knife cylinder 93 until reaching the preset number. When the preset number is reached, the sheet counter 81 sends out the adjustable control pulses P1 and P2 as described above with reference to FIG. 10. The control pulse P2, lasting approximately 350 ms, is sent to the vacuum valve solenoid 73 which then supplies a vacuum to the vacuum feet 61 from the vacuum chamber 65 for that amount of time. The vacuum feet 61 then extend and pick up a paper sheet 71 as illustrated in FIG. 5. Simultaneously with the control pulse P2, the control pulse P1, of approximately 35 ms or more, is sent to the clutch solenoid 28. The clutch solenoid 28 thus enables the clutch 27 for the same time period which is sufficient to turn the feed belt rollers 22 and 23 approximately 180 degrees which is sufficient to feed a single chipboard 35 (FIG. 7) under the knife 43 and into the pinch rollers 31 and 32. The pinch rollers 31 and 32 then eject the chipboard 35 at a speed controlled by the motor speed controller 83 toward the paper sheet lapstream at the point at which the vacuum feet 61 have picked up the paper sheet 71 (FIG. 5). In situations where multiple chipboards need to be inserted in the paper lapstream, such as when front and back covers are provided for tablets, the length of the pulse P1 is increased, thereby increasing the time that the clutch 27 is enabled to sequentially eject multiple chipboards 35. The chipboard or chipboards 35 arrive at the pick-up point just as the vacuum feet 61 have picked up the sheet 71, thus inserting the chipboard 35 under the picked-up sheet 71. As the paper sheet lapstream is fed by the conveyor 2 onto the support stand 3, the chipboards 35 are thus inserted at precisely those intervals preset by the input buttons 80 of the sheet counter 81 to create bundles of that size for later processing into writing tablets or the like. The batch counter 82 counts the number of bundles and the operation can be manually or automatically stopped when the batch counter reaches a required count. Note that it is the opposed direction of the chipboard flow from the chipboard ejector 14 which allows the inserter apparatus 1 to be portable and self-contained and attachable to any suitable lapstream conveyor.

In a preferred embodiment of the chipboard inserter apparatus 1, the U-shaped base 4 was constructed of steel while the other major support members including the vertical support member 5, the cantilevered chipboard ejector 14 and the vacuum chamber housing 44 were constructed of aluminum for reduced weight. Other suitable materials, including hard plastics could be utilized as well.

While the inserter apparatus 1 of the present invention has been shown and described as including a vacuum chamber housing 44 positioned above the paper lapstream, the vacuum chamber 65 could as easily be positioned beneath the ejector 14, thus shortening the required travel distance for the ejected chipboards 35. Furthermore, while a vacuum sheet pick-up operation has been disclosed herein, a retractable mechanical sheet separator could be used as well.

It is to be understood that while certain forms of the present invention have been illustrated and described herein, it is not to be limited to the specific forms or arrangement of parts described and shown.

What is claimed and desired to be secured by Letters Patent is as follows:

1. A chipboard inserter apparatus for inserting chipboard spacers between series of sheets within a sheet lapstream conveyed in a direction of movement on a lapstream conveyor, the apparatus comprising:
(a) sheet pick-up means for cyclically lifting a leading edge of a selected sheet on said conveyor; and
(b) chipboard ejector means for propelling a spacer in a direction opposite to the direction of movement of said lapstream conveyor to insert said spacer under said selected sheet.

2. The apparatus of claim 1, wherein:
(a) said sheet pick-up means comprises a plurality of vacuum feet connected to a vacuum chamber via a vacuum valve.

3. The apparatus of claim 2, wherein:
(a) spring means which is adapted to urge the trailing edge of said sheets on said conveyor downward to keep them in an overlapped condition as the vacuum feet lift the leading edge of said selected sheets.

4. The apparatus of claim 3 wherein:
(a) said spring means comprises a plurality of leaf springs which are laterally adjustable relative to said sheets.

5. The apparatus of claim 3 wherein:
(a) said vacuum feet are laterally adjustable relative to said sheets.

6. The apparatus of claim 3 and including:
(a) a vacuum pump for supplying a vacuum to said vacuum chamber.

7. The apparatus of claim 1 wherein:
(a) said chipboard ejector means includes a pair of pinch rollers rotatably driven in opposite directions by a motor to propel a spacer.

8. The apparatus of claim 7 wherein:
(a) said chipboard ejector means includes a spacer stack positioned on a feed belt connected to said motor by a clutch controlled by a clutch solenoid, said feed belt being operable to feed individual spacers from said stack into said pinch rollers.

9. The apparatus of claim 7 and including:
(a) a control panel including a sheet counter for counting the number of sheets on said conveyor and producing at least one output pulse when said number reaches a preset limit.

10. The apparatus of claim 9 wherein (a) said sheet pick-up means comprises a plurality of vacuum feet connected to a vacuum chamber via a vacuum valve; and (b) said output pulse is a vacuum control pulse which is sent to said vacuum valve to enable said vacuum valve to supply a vacuum to said vacuum feet and, thus, enable them to pick up said selected sheet.

11. The apparatus of claim 9 wherein:

(a) said chipboard ejector means includes a spacer stack positioned on a feed belt connected to said motor by a clutch controlled by a clutch solenoid, said feed belt being operable to feed individual spacers from said stack into said pinch rollers;

(b) said control pulse is a clutch control pulse which enables said clutch to engage said feed belt to feed a spacer to said pinch rollers.

12. The apparatus of claim 9, and further comprising:

(a) a batch counter for counting the number of times that said sheet counter reaches said preset limit.

13. The apparatus of claim 7 and including:

(a) a control panel including a speed controller for controlling the speed of said motor and, thus, a speed of ejection of said spacers from said chipboard ejector means.

14. The apparatus of claim 9 wherein:

(a) said sheet pick-up means comprises a plurality of vacuum feet connected to a vacuum chamber via a vacuum valve;

(b) said chipboard ejector means includes a spacer stack positioned on a feed belt connected to said motor by a clutch controlled by a clutch solenoid, said feed belt being operable to feed individual spacers from said stack into said pinch rollers;

(c) said sheet counter produces two output pulses when said number reaches a preset limit;

(d) a first one of said output pulses is sent to said vacuum valve to enable said vacuum valve to supply a vacuum to said vacuum feet and, thus, enable them to pick up said selected sheet; and (e) the second one of said output pulses is sent to said clutch solenoid to enable said clutch to engage said feed belt to feed a spacer to said pinch rollers.

15. A method of inserting chipboard spacers between series of sheets within a sheet lapstream conveyed in a direction of movement on a lapstream conveyor, the method comprising the steps of:

(a) cyclically picking up a leading edge of a selected sheet on said conveyor; and (b) propelling a spacer in a direction opposite to the direction of movement of said lapstream conveyor toward the point on said conveyor at which the leading edge of said selected sheet is being picked up to insert said spacers under said selected sheet.

16. A chipboard inserter apparatus for inserting spacers between series of sheets within a sheet lapstream on a lapstream conveyor, the apparatus comprising:

(a) sheet pick-up means including a plurality of vacuum feet connected to a vacuum chamber via a vacuum valve, said vacuum feet being positioned above the lapstream conveyor and being cyclically operable to lift a leading edge of a selected sheet;

(b) a chipboard ejector including a pair of pinch rollers rotatably driven in opposite directions by a motor, a spacer stack, and a feed belt connected to said motor by a clutch controlled by a clutch solenoid, said feed belt being operable to feed individual spacers into said pinch rollers, said pinch rollers propelling said spacers in a direction opposite that of the lapstream conveyor and toward the lapstream conveyor and beneath said selected sheet; and (c) a control panel including a sheet counter for counting the number of sheets on said conveyor and producing two output pulses when said number reaches a preset limit, one of which is sent to said vacuum valve to enable said vacuum valve to supply a vacuum to said vacuum feet and thus enable said feet to lift said selected sheet, the other of said control pulses being sent to said clutch solenoid to enable said clutch to activate said feed belt to feed a spacer to said pinch rollers.

17. The apparatus of claim 16, and further comprising:

(a) a batch counter for counting the number of times that said sheet counter reaches said preset limit.

18. The apparatus of claim 16 wherein:

(a) the lengths of said control pulses are adjustable to accommodate different sizes of paper sheets and/or to sequentially eject multiple spacers into a single position in said lapstream.

19. The apparatus of claim 18, and further comprising:

(a) a plurality of leaf springs adapted to urge trailing edges of said sheets downward on said conveyor to keep said sheets in an overlapped condition as the vacuum feet lift the leading edge of said selected sheet, said leaf springs being laterally adjustable relative to said sheets.

20. The apparatus of claim 19 wherein:

(a) said vacuum feet are laterally adjustable relative to said sheets.

21. The apparatus of claim 20 and further including:

(a) a vacuum pump for supplying a vacuum to said vacuum chamber.

22. The apparatus of claim 16, said control panel further comprising:

(a) a speed controller for controlling the speed of said motor and, thus, a speed of ejection of said spacers from said chipboard ejector means.

23. A chipboard inserter apparatus for inserting chipboard spacers between series of sheets within a sheet lapstream conveyed in a direction of movement on a lapstream conveyor, the apparatus comprising:

(a) sheet pick-up means for cyclically lifting a leading edge of a selected sheet on said conveyor;

(b) chipboard ejector means for propelling a spacer toward said lapstream to insert said spacer under said selected sheet, said chipboard ejector including a pair of pinch rollers rotatably driven in opposite directions by a motor to propel a spacer; and (c) a speed controller for controlling the speed of said motor and, thus, a speed of ejection of said spacers from said chipboard ejector means.

* * * * *